US006247475B1

(12) United States Patent
Sato

(10) Patent No.: US 6,247,475 B1
(45) Date of Patent: Jun. 19, 2001

(54) DEVICE FOR COMPRESSING AND MOLDING A FILLER STREAM IN A CIGARETTE MANUFACTURING MACHINE

(75) Inventor: Kiyomi Sato, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 09/223,374

(22) Filed: Dec. 30, 1998

(30) Foreign Application Priority Data

Jan. 12, 1998 (JP) ..... 10-004088

(51) Int. Cl.[7] ..... A24C 5/18; A24C 1/18; A24C 3/00; B28B 17/00

(52) U.S. Cl. ..... 131/84.3; 131/77; 131/78; 131/84.1; 131/85; 131/84.2; 425/174.2

(58) Field of Search ..... 131/77, 78, 84.1, 131/84.3, 85, 84.2, 285; 425/174.2

(56) References Cited

U.S. PATENT DOCUMENTS 4,729,387 * 3/1988 Steiniger et al. ..... 131/84.1

FOREIGN PATENT DOCUMENTS 555875A 8/1993 (EP) .
803205A 10/1997 (EP) .
2156987A 10/1985 (GB) .
62-33588 8/1987 (JP) .

* cited by examiner

*Primary Examiner*—Stanley S. Silverman
*Assistant Examiner*—Dionne A. Walls
(74) *Attorney, Agent, or Firm*—Birch, Stewart, Kolasch & Birch, LLP

(57) ABSTRACT

In a cigarette manufacturing machine, a device for compressing and molding a filler stream includes a tongue, which defines a part of a compression-molding passage. The filler stream passes the compression-molding passage. The device further includes an ultrasonic vibration system for vibrating the tongue. The tongue functions as a horn of the ultrasonic vibration system.

10 Claims, 3 Drawing Sheets

DEVICE FOR COMPRESSING AND MOLDING A FILLER STREAM IN A CIGARETTE MANUFACTURING MACHINE

BACKGROUND OF THE INVENTION

1. Field of the Invention

The present invention relates to a device for compressing and molding a shredded tobacco or a filler stream before the filler stream is wrapped in wrapping paper in a cigarette manufacturing machine.

2. Description of the Related Art

In a cigarette manufacturing machine, a suction band sucks and attracts shredded tobacco into a form of layer so that a filler stream is formed on the suction band, and then travels the filler stream to one direction. The filler stream is peeled off from the suction band, and then is transferred onto wrapping paper, and thus passes through a compression-molding passage together with the wrapping paper. In a process of passing through the compression-molding passage, the filler stream is compressed and molded into a predetermined shape. Thereafter, the filler stream is wrapped in the wrapping paper, and then a tobacco rod is continuously formed. In the compression-molding passage, the compression-molding for the filler stream is significant in order to wrap the filler stream in the wrapping paper after that, that is, to stably formed the tobacco rod.

The formed tobacco rod is cut into individual cigarette rods having a predetermined length. The individual cigarette rods have a length twice as much as the cigarette portion of a filter-tipped cigarette. When the cigarette rod are supplied to a filter attachment, two filter-tipped cigarettes are manufactured from individual cigarette rods.

As shown in Japanese Utility Model Kokoku 62-33588 (27-8-1987), the aforementioned compression-molding passage is defined between a forming bed for guiding a travel of wrapping paper and a so-called tongue. The tongue has a shoe for peeling the filler stream from the suction band at its distal edge.

The tongue is a fixed member. Thus, in the case where the filler stream passes through the compression-molding passage, the tongue is a large resistance to the filler stream. For this reason, the shredded tobacco in the filler stream is easy to be broken by the tongue, and further the velocity of the filler stream fluctuates when passing through the compression-molding passage. The aforementioned breakage of the shredded tobacco and the velocity fluctuation of the filler stream are a factor of irregularly generating a hard spot and a soft spot relative to a filling density of the shredded tobacco in the filler stream. More specifically, the hard spot is a portion where the filling density is higher than a standard value; on the other hand, the soft spot is a portion where the filling density is lower than the standard value.

The hard spot in the filler stream causes filler stream jam in the compression-molding passage, and is a factor of causing a stoppage of the cigarette manufacturing machine. In the cigarette manufacturing machine, there is a tendency for the aforementioned filler stream jam to be frequently caused when forming a tobacco rod for a new brand cigarette or a different brand cigarettes.

On the other hand, when cutting the tobacco rod to obtain cigarette rod, there is the possibility that the soft spot in the filler stream exists in cut ends of the cigarette rod. In such a case, the shredded tobacco is easy to drop from the cut ends of the cigarette rod and a cut end of the filter-tipped cigarette.

SUMMARY OF THE INVENTION

An object of the present invention is to provide a compression-molding device for a filler stream, which can prevent the filler stream from being jammed in a compression-molding passage, and can make uniform a filling density of a shredded tobacco filled in a tobacco rod.

The above object is achieved by a compression-molding device of the present invention. The compression-molding device includes a molding surface for defining a part of a compression-molding passage for passing a filler stream, and vibration means for vibrating the molding surface.

When the filler stream passes through the compression-molding passage, the molding surface is in a vibrating state. The vibration of the molding surface greatly reduces a coefficient of kinetic friction between the molding surface and the filler stream, so that the filler stream can be compressed and molded while smoothly passing through the compression-molding passage. Therefore, it is possible to greatly restrict breakage of the shredded tobacco in the compression-molding passage and a velocity fluctuation of the filler stream, so that the aforementioned hard spots and soft spots can be effectively prevented from being generated. As a result, the filler stream is prevented from being jammed in the compression-molding passage, therefore, the rate of operation of the cigarette manufacturing machine can be improved. Further, it is possible to improve a quality of the tobacco rod, that is, cigarette rods manufactured in the cigarette manufacturing machine.

The vibration means comprises an ultrasonic vibration system. The system includes an ultrasonic vibrator having a vibration surface, and a horn in which a vibration from the vibration surface of the vibrator is propagated. The horn has a molding surface. In the case where the molding surface is vibrated by an ultrasonic wave, amplitude of the vibration of the molding surface can be smaller restricted. Thus, even if a velocity of the filler stream is made high, the molding surface does not become a great resistance to the passage of filler stream.

A vibrating direction of the molding surface by the ultrasonic wave may be any of a direction intersecting an axis of the compression-molding passage or an axial direction of the compression-molding passage.

In the case where the molding surface is vibrated to the direction intersecting an axis of the compression-molding passage, a distance $L_1$ between the vibration surface of the ultrasonic vibrator and the molding surface is obtained by the following equation.

$$L_1=n\cdot(\lambda/2)$$

where $\lambda$ is a wavelength of vibration generated by the ultrasonic vibrator, and n is an integer.

In this case, the molding surface is located at an antinode of the ultrasonic vibration, and can vibrate with the greatest amplitude.

In the case where the molding surface is vibrated to the axial direction of the compression-molding passage, when viewing from a passing direction of the filler stream, a distance $L_2$ between the vibration surface of the ultrasonic vibrator and a downstream end of the molding surface, and a distance $L_3$ between the vibration surface of the ultrasonic vibrator and an upstream end of the molding surface are respectively obtained by the following equations.

$$L_2=\lambda/4+i\cdot(\lambda/2)$$

$$L_3=\lambda/4+j\cdot(\lambda/2)$$

where i and j are each an integer, and have a relation of j>i.

In this case, the downstream end of the molding surface functions as a nodal point of the ultrasonic vibration. Therefore, the vibration of the molding surface gives fluidity toward the downstream end of the molding surface to the shredded tobacco contacting with the downstream side portion of the molding surface. This fluidity of the shredded tobacco serves to effectively prevent the filler stream from being jammed in the compression-molding passage.

Meanwhile, if a position of the upstream end of the molding surface is set as $L_3$, the upstream end of the molding surface can be formed as a scraper edge for peeling the filler stream from the suction band. In this case, the upstream end of the molding surface functions as a nodal point; therefore, the vibration of the molding surface does not affect the suction band.

Further scope of applicability of the present invention will become apparent from the detailed description given hereinafter. However, it should be understood that the detailed description and specific example, while indicating preferred embodiment of the invention, are given by way of illustration only, since various change and modification within the spirit and scope of the invention will become apparent to those skilled in the art from this detailed description.

BRIEF DESCRIPTION OF THE DRAWINGS

The present invention will become more fully understood from the detailed description given hereinafter and the accompany drawings which are given by way of illustration only, and thus, are not limitative of the present invention, and wherein.

DETAILED DESCRIPTION OF THE PREFERRED EMBODIMENTS

Figure 1:
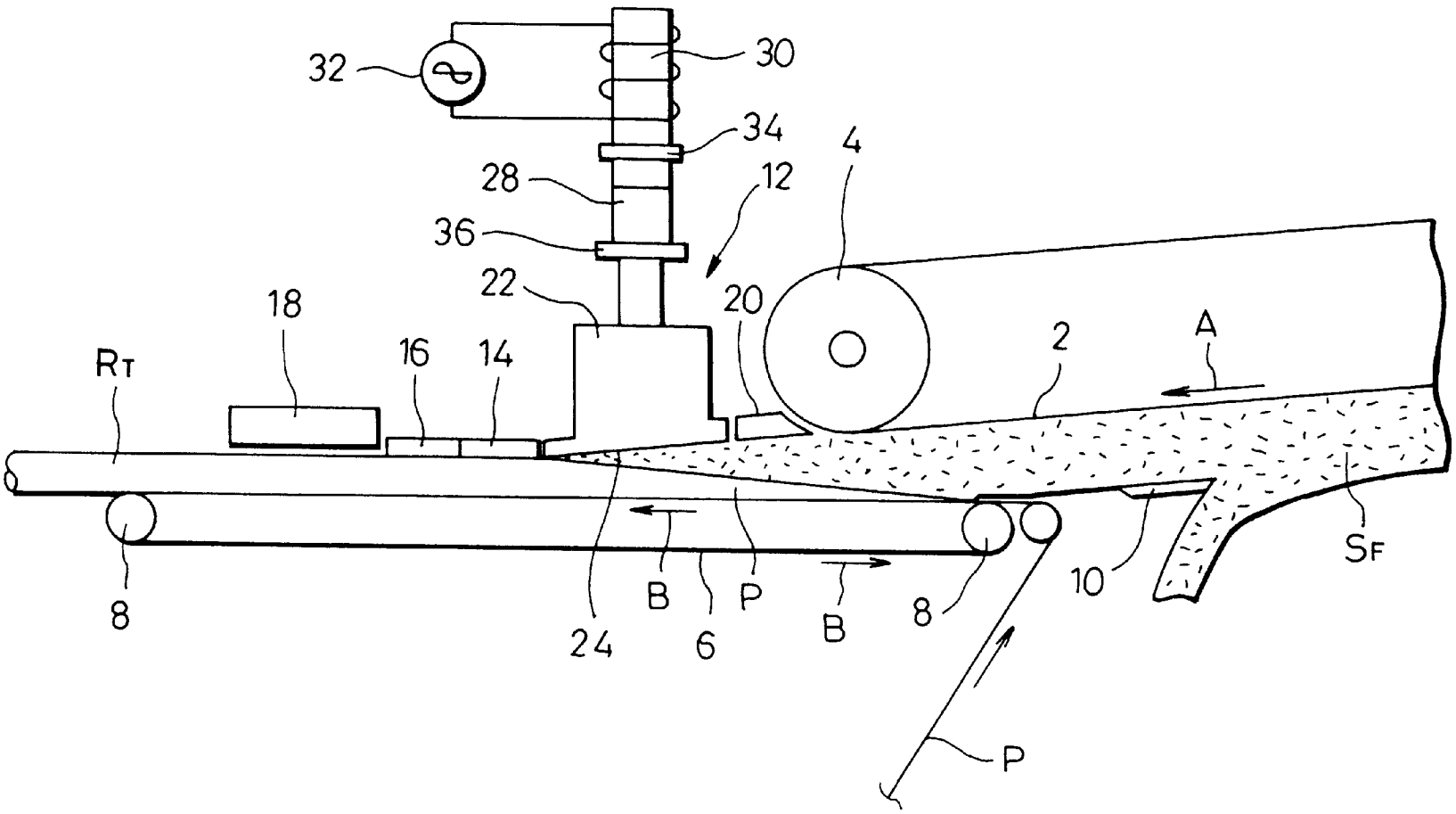
FIG. 1 is a view schematically showing a compression-molding device according to a first embodiment of the present invention.

Referring now to FIG. 1, a cigarette manufacturing machine comprises an endless suction band 2. The suction band 2 is stretched between a drive pulley 4 and a driven pulley (not shown) and passes around these pulleys. With a rotation of the drive pulley 4, the suction band 2 travels toward an arrow A direction of FIG. 1 at a predetermined speed. The suction band 2 has a suction surface at the lower surface thereof. The suction surface passes just above an opening of a chimney (not shown). The chimney blows up shredded tobacco toward the suction band 2. Then, the suction band 2 sucks and attracts the shredded tobacco blown up into a form of layer so that a shredded tobacco layer, that is, a filler stream $S_F$ is formed. The filler stream $S_F$ travels toward the arrow direction A together with the suction band 2.

The machine further comprises an endless garniture tape 6. The garniture tape 6 is guided by means of a drive drum (not shown) and a plurality of guide pulleys 8 so as to have a horizontally extending portion. A horizontal portion of the garniture tape 6 extends from the lower region of the drive pulley 4 to the traveling direction of the filler stream $S_F$. Further, the horizontal portion of the garniture tape 6 is placed on a forming bed (see FIG. 2) of the cigarette manufacturing machine, and travels toward an arrow B direction of FIG. 1 at a predetermined speed with the rotation of drive drum. The drive drum is connected to a main shaft of the machine.

The horizontal portion of the garniture tape 6 receives wrapping paper P on the upper surface thereof. The wrapping paper P is fed from a roll (not shown) to a leading end of the horizontal portion of the garniture tape 6, and then travels together with the garniture tape 6.

As shown in FIG. 1, the filler stream $S_F$ passes through a pair of trimming disks 10 before reaching the drive pulley 4. These trimming disks 10 are arranged below the suction band 2 and adjust a thickness of the filler stream $S_F$ in cooperation with each other. Therefore, the suction band 2 supplies the trimmed filler stream $S_F$ toward the wrapping paper P on the garniture tape 6.

The aforementioned forming bed is provided with a compression-molding device 12 of a first embodiment, rod formers 14 and 16, and a heater 18 at the top portion thereof. These devices are arranged successively along the traveling direction of the garniture tape 6 in a state of being adjacent to each other.

The compression-molding device 12 includes a shoe 20 and a tongue 22. The shoe 20 is fixed onto a frame of the cigarette manufacturing machine and has a distal end adjacent to the drive pulley 4 of the suction band 2. The distal end of the shoe 20 functions as a scraper edge which peels off the filler stream $S_F$ from the suction band 2. On the other hand, the tongue 22 extends from a rear end of the shoe 20 to the traveling direction of the garniture tape 6. Further, the tongue 22 compresses and molds the filler stream $S_F$ peeled by the shoe 20 while guiding the filler stream $S_F$. Namely, the tongue 22 defines a compression-molding passage for the filler stream $S_F$ in cooperation with a molding groove 27 on the forming bed 26. The molding groove 27 will be described later.

More specifically, the tongue 22 has a molding surface 24 at the lower surface thereof. Preferably, the molding surface 24 extends smoothly with respect to the lower surface of the shoe 20. The molding surface 24 has a shape of arc in cross section. Further, a curvature of the arc of the molding surface 24 gradually increases from an inlet of the compression-molding passage toward an outlet thereof. In the outlet of the compression-molding passage, the molding surface 24 has a substantially semi-circular shape in cross section. As is evident from FIG. 1, the molding surface 24 is inclined downwardly toward the traveling direction of the garniture tape 6, and an outlet height of the compression-molding passage is lower than an inlet height thereof.

Figure 2:
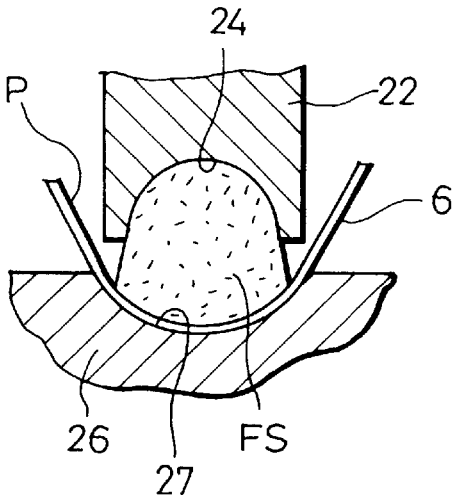
FIG. 2 is a cross sectional view showing a compression-molding passage shown in FIG. 1.

Meanwhile, as is evident from FIG. 2, the molding groove 27 of the forming bed 26 has a shape of arc in cross section and extends to the traveling direction of the garniture tape 6. The molding groove 27 bends the garniture tape 6 into a U-shape together with the wrapping paper P while guiding the travel of the garniture tape 6. A curvature, that is, a depth of the molding groove 27 gradually increases from the leading end of the horizontal portion of the garniture tape 6 toward the outlet of the compression-molding passage. In the outlet of the compression-molding passage, the molding groove 27 has a substantially semi-circular shape in cross section.

When the filler stream $F_s$ passes through the compression-molding passage, the filler stream $F_s$ is guided to the molding surface 24 of the tongue 22, and then is compressed by the molding surface 24 from the top thereof. More specifically, an upper half portion of the filler stream $F_s$ is gradually narrowed in its width, and finally has a semicircular shape in cross section. At this time, the wrapping paper P is gradually bent by means of the molding groove 27 of the forming bed 26 together with the garniture tape 6. Namely, the wrapping paper P compresses and molds a lower half portion of the filler stream $S_F$ from below in a process of being bent into a U-shape. Therefore, after the filler stream $S_F$ passes through the compression-molding passage, the filler stream $S_F$ has a substantially semi-circular shape in cross section.

Thereafter, when the filler stream $S_F$ passes through the rod formers 14 and 16 successively together with the wrapping paper P, the rod former 14 on an upstream side bends one side portion of the U-shaped wrapping paper P so that the one side portion covers a part of the upper half portion of the filler stream $S_F$. At this time, glue is applied onto the edge of other side portion of the U-shaped wrapping paper P by means of a glue applicator (not shown). Likewise, the rod former 16 on an downstream side bends the other side portion of the wrapping paper P so that the other side portion covers the reminder of the upper half portion of the filler stream $S_F$, and then both side portions are overlapped so as to be glued to each other. At this time, the filler stream $S_F$ is fully wrapped in the wrapping paper P to form a tobacco rod RT. The tobacco rod $R_T$ is continuously fed from the former 16.

Thereafter, when the tobacco rod $R_T$ passes through the heater 18, a glued portion of the wrapping paper P is dried, and then the tobacco rod $R_T$ is supplied to a cutting section (not shown). In the cutting section, the tobacco rod $R_T$ is cut into individual cigarette rods having a predetermined length.

The aforementioned compression-molding device 12 further comprises an ultrasonic vibration system. This system uses the tongue 22 as a horn. More specifically, the tongue 22 is connected to a vibrator 30 via a booster 28, which are vertically arranged in series. The vibrator 30 includes a piezoelectric semiconductor, and is electrically connected to an oscillator 32. Further, the vibrator 30 has a nodal point 34 that is held by means of an O ring.

The booster 28 amplifies a vibration generated in a vibration surface 31 of the vibrator 30, and propagates the amplified vibration to the tongue 22. Namely, the booster 28 has a nodal point 36, and a mass of the upper portion from the nodal point 36 is larger than a mass of the lower portion from the nodal point 36.

Figure 3:
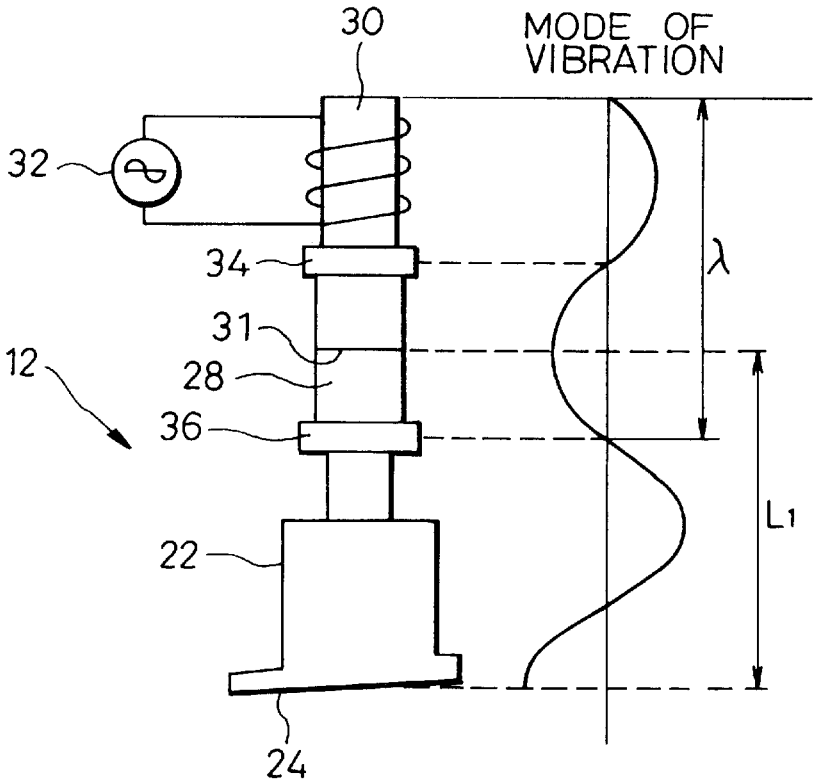
FIG. 3 is a view showing an ultrasonic vibration system applied to the device shown in FIG. 1 and the vibration mode.

Assuming that a wavelength of the vibration generated in the vibration surface 31 of the vibrator 30 is expressed as $\lambda$, a vibration propagating distance from the vibration surface 31 to the center of the molding surface 24 of the horn 22, that is, a distance $L_1$ as shown in FIG. 3 is obtained by the following equation.

$$L_1 = n \cdot (\lambda/2)$$

where n is an integer.

When the distance $L_1$ is set in the above-mentioned manner, as seen from the FIG. 3, the molding surface 24 can vibrate with the greatest amplitude. In the case where the booster 28 is interposed between the vibrator 30 and the horn 22, a vibration wavelength $\lambda$ of the vibrator 30 is expressed by a distance between the upper end of the vibrator 30 and the nodal point 36 of the booster 28.

As described above, when the tongue 22 functions as a horn of the ultrasonic vibration system, the molding surface 24 vibrates vertically, and then periodically contacts with the filler stream $F_s$ in the compression-molding passage. Namely, a coefficient of kinetic friction between the molding surface 24 and the filler stream $S_F$ greatly decreases, for this reason, the tongue 22 is not a great resistance to a travel of the filler stream $S_F$. Therefore, it is possible to greatly reduce breakage of the shredded tobacco in the filler stream $S_F$ and a velocity fluctuation of the filler stream $S_F$ in the compression-molding passage, so that the aforementioned hard spots and soft spots can be prevented from being generated.

As a result, the filler stream $S_F$ is prevented from being jammed in the compression-molding passage, therefore, a rate of operation of the cigarette manufacturing machine can be improved. Further, a filling density of the shredded tobacco filled in the tobacco rod $R_T$ becomes uniform, therefore, a quality of the cigarette rods can be improved.

Cigarette rods of different brands X, Y and Z have been respectively manufactured with the use of the cigarette manufacturing machine including the aforementioned compression-molding device 12. Regarding manufacture of respective brand cigarette rods, a rate of operation of the machine, and a variation in a weight of the cigarette rod, that is, a standard deviation of the weight are shown in the following table. Further, in the table, there are shown the rate of operation of a conventional cigarette manufacturing machine, and the standard deviation of a weight of cigarette rod manufactured with the use of the conventional machine. The conventional cigarette manufacturing machine includes a compression-molding device having a fixed type tongue.

In this case, the operation rate of the cigarette manufacturing machine is expressed by the following equation.

$$\text{Operation rate} = ((\text{operating time} - \text{stopping time})/\text{operating time}) \times 100$$

Also, a frequency of the ultrasonic wave generated by the vibrator 30 is 20 kHz, and amplitude of the vibration of the molding surface 24 is 15 $\mu$m.

Further, the standard deviation of cigarette rod weight serves as an index indicative of coarseness and denseness in the filling density of the shredded tobacco filled in the cigarette rod.

TABLE

| | Operating time (h) | Stopping time (h) | Operation rate (%) | Standard deviation of cigarette weight (%) |
|---|---|---|---|---|
| Brand X | 330 | 316 | 95.7 | 1.8 |
| Brand Y | 310 | 294 | 94.8 | 1.9 |
| Brand X | 380 | 362 | 95.3 | 1.8 |
| Fixed type tongue | | | 85–90 | 2.1–2.3 |

As is evident from the above table, in the case where a comparison is made between the ultrasonic vibration type tongue 22 and the above fixed type tongue, the following facts can be found out.

In the machine including the ultrasonic vibration type tongue 22, the operation rate is improved, and also, the weight standard deviation of the cigarette rod is smaller. This means that the tongue 22, that is, the vibration of the molding surface 24 greatly reduces a resistance of the compression-molding passage.

Moreover, even if a frequency of the ultrasonic wave generated by the vibrator 30 ranges from 10 to 40 kHz, and amplitude of the vibration of the molding surface 24 ranges from 5 to 50 $\mu$m, the same result as shown in the above table is obtained.

Next, each compression-molding device 12 of second and third embodiments will be described below with reference to FIG. 4 and FIG. 5. In the case of explaining these compression-molding devices 12 of the second and third embodiments, like reference numerals are used to denote members and portions having the same function as those of the aforementioned first embodiment, and these details are omitted.

Figure 4:
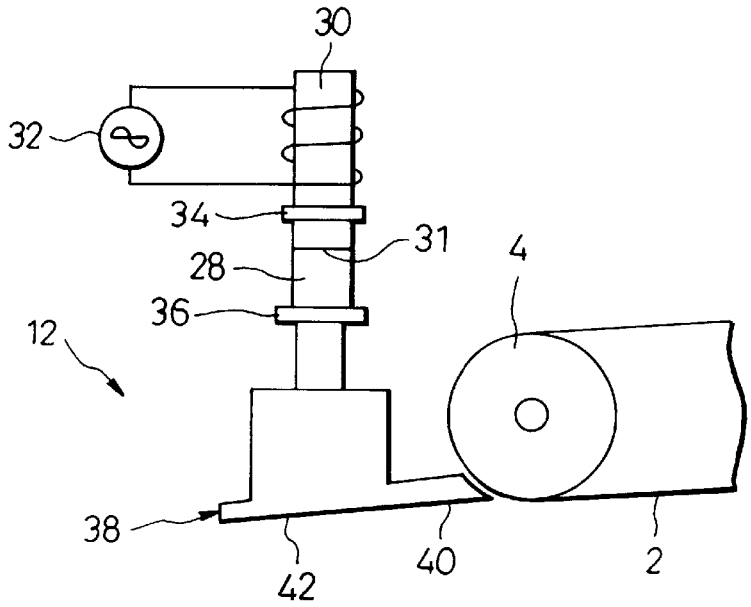
FIG. 4 is a view schematically showing a compression-molding device according to a second embodiment of the present invention.

As shown in FIG. 4, a compression-molding device 12 of the second embodiment includes a tongue 38. The tongue 38 is molded integrally with a shoe 40. In this case, a molding surface 42 is formed of lower surfaces of both tongue 38 and shoe 40. The tongue 38 having the shoe 40 functions as a horn of an ultrasonic vibration system as a whole, and integrally vibrates. The tongue 38 can also reduce a resistance of the compression-molding passage, like the tongue 22 mentioned before.

Figure 5:
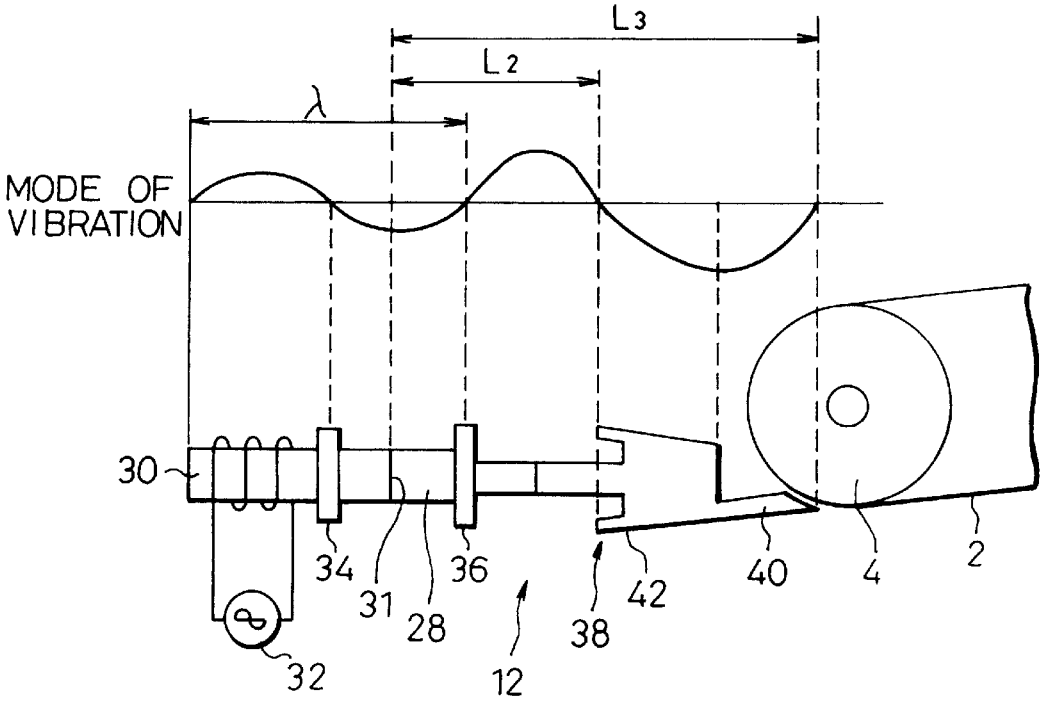
FIG. 5 is a view schematically showing a compression-molding device according to a third embodiment of the present invention.

As shown in FIG. 5, a compression-molding device 12 of the third embodiment includes an ultrasonic vibration system, which is horizontally arranged. More specifically, the vibrator 30, the booster 28 and the tongue 38 functioning as a horn constitutes the ultrasonic vibration system, and are horizontally connected in series. In this case, when viewing from the passing direction of the filler stream $S_F$, a distance $L_2$ between a vibration surface 31 of the vibrator 30 and a downstream end of the tongue 38 (rear end of the molding surface 42), and a distance $L_3$ between the vibration surface 31 of the vibrator 30 and an upstream end of the shoe 40 (distal edge of the molding surface 42), are obtained by the following equations.

$$L_2=\lambda/4+i\cdot(\lambda/2)$$

$$L_3=\lambda/4+j\cdot(\lambda/2)$$

where i and j are each an integer, and have a relation of j>i.

In the case of the compression-molding device of FIG. 5, the molding surface 42 of the tongue 38 and the shoe 40 horizontally vibrates. As described above, even in the case where the molding surface 42 vibrates not vertically but horizontally, a coefficient of kinetic friction between the molding surface 42 and the filler stream $S_F$ becomes small, therefore, the resistance of the compression-molding passage can be greatly reduced.

As is evident from FIG. 5, a vibration mode of the tongue 38 has a nodal point at each of the read edge of the tongue 38 and the distal edge of the shoe 40. Thus, fluidity toward the outlet edge of the molding surface 42 is given to the shredded tobacco contacting with the downstream side portion of the molding surface 42, so that a passing characteristic of the filler stream $S_F$ does not become worse in the compression-molding passage. Further, the distal end of the shoe 40 gives no influence to the suction band 2, so that the shoe 40 can sufficiently exhibit the original function as a scraper.

The horizontal vibration of the tongue 38 is applicable to the tongue 22 of FIG. 1; in this case, the distal and rear ends of the tongue 22 function as the upstream and downstream ends of the molding surface 24, respectively. Further, the vibration direction to be given to the tongue is not specially limited to the vertical direction and the horizontal direction, and may be an oblique direction. Furthermore, the tongue may be vibrated by various systems without limiting the aforementioned the ultrasonic vibration.

What is claimed is:

1. A device for compressing and molding a filler stream, which includes a shredded tobacco, peeled from a suction band in a cigarette manufacturing machine before the filler stream is wrapped in wrapping paper, the device comprising:

a molding member located at a downstream side of the suction band, said molding member including a molding surface for defining a compression-molding passage between the wrapping paper and the molding surface so that the compression-molding passage allows the filler stream to pass therein from the suction band, said molding surface having an upstream end and a downstream end when viewing from a passing direction of the filler stream; and vibration means for vibrating said molding surface.

2. The device according to claim 1, wherein said vibration means comprises an ultrasonic vibration system which includes an ultrasonic vibrator having a vibration surface and a horn for receiving a propagation of vibration from the vibration surface of the ultrasonic vibrator, the horn having said molding surface.

3. The device according to claim 2, wherein said vibration means vibrates said molding surface to a direction intersecting with an axis of the compression-molding passage.

4. The device according to claim 3, wherein if a wavelength of vibration of the ultrasonic vibrator is expressed as λ and an integer is expressed as n, a distance $L_1$ between the vibration surface of the ultrasonic vibrator and said molding surface is obtained by the following equations:

$$L_1=n\cdot(\lambda/2).$$

5. The device according to claim 4, wherein the upstream end of said molding surface is formed as a scraper edge for peeling the filler stream from the suction band.

6. The device according to claim 2, wherein said vibration means vibrates said molding surface to an axial direction of the compression-molding passage.

7. The device according to claim 6, wherein if a wavelength of vibration of the ultrasonic vibrator is expressed as λ and an integer is expressed as i, a distance $L_2$ between the vibration surface of the ultrasonic vibrator and the downstream end of said molding surface is obtained by the following equations:

$$L_2=\lambda/4+i\cdot(\lambda/2).$$

8. The device according to claim 6, wherein if a wavelength of vibration of the ultrasonic vibrator is expressed as λ and an integer is expressed as j, a distance $L_3$ between the vibration surface of the ultrasonic vibrator and the upstream end of said molding surface is obtained by the following equations:

$$L_3=\lambda/4+j\cdot(\lambda/2).$$

9. The device according to claim 6, wherein if a wavelength of vibration of the ultrasonic vibrator is expressed as λ and an integer is expressed as i, j (>i), a distance $L_2$ between the vibration surface of the ultrasonic vibrator and the downstream end of said molding surface, and a distance $L_3$ between the vibration surface of the ultrasonic vibrator and the upstream end of said molding surface are respectively obtained by the following equations:

$$L_2=\lambda/4+i\cdot(\lambda/2)$$

$$L_3=\lambda/4+j\cdot(\lambda/2).$$

10. The device according to claim 6, wherein the upstream end of said molding surface is formed as a scraper edge for peeling the filler stream from the suction band.

* * * * *